United States Patent [19]

Keenan

[11] Patent Number: 4,629,935

[45] Date of Patent: Dec. 16, 1986

[54] TUNGSTEN-HALOGEN LAMP WITH ORGANIC AND INORGANIC GETTERS

[75] Inventor: James P. Keenan, Reading, Mass.

[73] Assignee: GTE Products Corporation, Stamford, Conn.

[21] Appl. No.: 700,362

[22] Filed: Feb. 11, 1985

[51] Int. Cl.[4] ..... H01K 1/50; H01K 1/54

[52] U.S. Cl. ..... 313/579

[58] Field of Search ..... 313/579

[56] References Cited

U.S. PATENT DOCUMENTS 1,600,203 9/1926 Campbell .
3,538,373 11/1970 Linden et al. .
3,712,701 1/1973 Johnston et al. .
3,912,960 10/1975 Danko ..... 313/579
3,912,961 10/1975 Rees et al. ..... 313/579
4,039,879 8/1977 T'jampens et al. ..... 313/579
4,532,455 7/1985 Connor et al. ..... 313/579

*Primary Examiner*—Palmer C. DeMeo
*Attorney, Agent, or Firm*—José W. Jimenez

[57] ABSTRACT

A tungsten halogen lamp which utilizes a quantity, in combination, of an organic getter and inorganic getter for the purposes of substantially eliminating contaminants contained within the lamp and substantially reducing filament sag. In particular, the organic getter may be in the form of a carbon-containing halide, such as methyl bromide, and the inorganic getter may be in the form of a phosphorus-based gaseous getter, such as phosphine.

6 Claims, 1 Drawing Figure

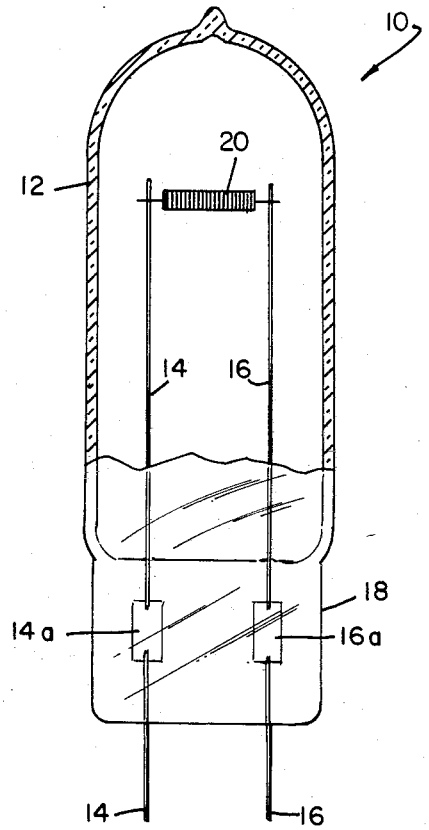
10
20
12
14
16
18
14a
16a
14
16

TUNGSTEN-HALOGEN LAMP WITH ORGANIC AND INORGANIC GETTERS

CROSS REFERENCE TO CO-PENDING APPLICATIONS

In co-pending Application having Ser. No. 700,361 ("Tungsten-Halogen Lamp with Means for Reducing Filament Embrittlement"), there is defined a lamp having two substances for example a carbon-containing compound and a phosphorus-based compound, in a preferred ratio of quantities for the purpose of substantially reducing filament embrittlement leading to reduced lamp life. This Application is filed concurrently herewith and is assigned to the same assignee as the instant invention.

In co-pending Application having Ser. No. 321,994 ("Electric Lamp Including Oxygen Getter"), there is defined a lamp containing phosphine ($PH_3$) gas for the purpose of serving as an oxygen getter. This Application was filed on Nov. 16, 1981 and was assigned to the same assignee as the instant invention.

TECHNICAL FIELD

This invention relates to incandescent lamps and more particularly to tungsten-halogen incandescent lamps. Still more particularly, it relates to lamps of the latter variety having means, incorporated therein, for substantially eliminating contaminants contained within and for preventing filament sag.

BACKGROUND OF THE INVENTION

The majority of incandescent lamps today use a filament made from tungsten wire which can be of the single or coiled coil design. When initially energized to incandescence, the filament will both metallurgically recrystallize and physically sag under gravitational attraction. Coiled coil filaments, for the most part, have a tendency of sagging more than do single coil filaments and fine wire has a tendency of sagging more than does heavy wire.

In the vertical position, sag is characterized by a collapsing of turns with open turns at the top and compression at the bottom. Sag in the horizontal position is characterized by the formation of one or more catenaries depending on the number of filament support wires.

The preliminary sag in tungsten filaments has never been completely eliminated. However, it can be significantly reduced by utilizing a controlled heating process at the time of initial light-up. Flashing is one particular process known for doing this and is now in common use. Briefly, flashing is a method of stabilizing a filament. It is usually done after the coil is mounted in the lamp and can be performed either before or after tip-off. Since the filament as received is not brittle, it does not require hand mounting and, therefore, can be mounted inexpensively via high speed automatic equipment. Initial light-up under these conditions results in more preliminary sag than on a pre-stabilized coil.

Unfortunately, the filament in an incandescent lamp will continue to sag during subsequent lamp operation in spite of flashing. This is generally attributed to a slippage at the grain boundaries. The condition is known to be aggravated by the presence of oxygen in the vapor state. This accounts for a higher degree of sag in halogen lamps because the halogen regenerative cycle retains a higher percentage of oxygen in the vapor state than there is in a non-halogen incandescent lamp.

Generally, the sag in non-halogen incandescent lamps is not severe because most of the residual oxygen is tied up on the bulb wall as tungsten oxide, a colorless solid condensate. Thus, a sufficient quantity of oxygen is not available in the vapor state to promote sagging.

However, in halogen lamps secondary sag and contamination can be a serious problem due to the fact that any oxides present can be reduced by the halogen or halide additive (HBr in this case) which promotes the presence of free oxygen in the vapor state. Also, chemical corrosion of the wire in the cooler sections of the filament results in a significant reduction in life as caused by thinning and premature arcing. This is more pronounced in fine wire than it is in heavy wire.

There are numerous techniques now in use attempting to solve the problem of the existence of contaminants within the halogen lamp and sag of the filament in lamps of this type. Most of these techniques introduce new problems which force a compromise with respect to lamp performance. For the purposes of clarity, some of the more widely used techniques are briefly described here.

Reduced Halogen Content—It has been shown by tests that a reduction in halogen content in the fill gas will give rise to corresponding reduction in filament sag and corrosion. Unfortunately, it will also result in an increase in the percentage of lamps which will turn black prematurely due to failure of the halogen regenerative cycle. Lamp blackening of any halogen lamp constitutes lamp failure even if the filament continues to burn.

Other Halides—The halide additive often used is Hydrogen Bromide (HBr). It is considered by some lamp manufacturers to be too corrosive and, therefore, less desirable than the carbonaceous halides. Tests run fail to show any advantage to using this latter type of halide ($CH_2Br_2$, for example). Also, a serious defect arises when using this gas. The result is a significant attenuation of light output which is caused by a carbon layer deposited on the inner bulb wall during initial light-up when the $CH_2Br_2$ is decomposed into a more elemental form.

It is believed, therefore, that a tungsten-halogen lamp that provides for means for substantially eliminating contaminants from within the lamp and substantially reduces filament sagging would constitute an advancement in the art.

DISCLOSURE OF THE INVENTION

It is, therefore, a primary objective of this invention to overcome the advantages of the prior art devices such as mentioned above.

It is another object of this invention to provide a lamp with means to eliminate the contaminants contained therein, which attack the supports or lead wires and the filament, that will enhance the performance of such a lamp.

Still another object of this invention is to substantially eliminate the possibility of filament sag in tungsten-halogen lamps.

In accordance with one aspect of the present invention, there is provided a tungsten-halogen incandescent lamp comprising a light-transmitting, hermetically sealed envelope and a pair of lead-in wires press sealed in the envelope and extending internally and externally of the envelope. In addition, the lamp includes a tungsten filament attached between the internal ends of the lead-in wires and a fill gas within the envelope consisting of an inert gas and a halogen or halide. Furthermore, the lamp includes means for gettering oxygen contained within the envelope which comprises an organic getter in combination with an inorganic getter. More specifically, the organic getter comprises a carbon-containing gaseous compound, and the inorganic getter comprises a phosphorus-based gaseous compound.

BRIEF DESCRIPTION OF THE DRAWING

The FIGURE illustrates one embodiment of the tungsten-halogen lamp made in accordance with the teachings of the present invention.

BEST MODE FOR CARRYING OUT THE INVENTION

For a better understanding of the present invention, together with other and further objects, advantages, and capabilities thereof, reference is made to the following disclosure the appended claims in conjunction with the above described drawing.

Referring now to the drawing with greater particularity, the FIGURE shows a tungsten-halogen lamp 10 made in accordance with the teachings of the present invention. It is to be understood that lamp 10 is representative of only one of several varieties of electric lamps capable of successfully utilizing the gettering combination of the instant invention. Accordingly, the scope of the invention is not to be limited to the particular lamp 10 as shown and described herein below.

Lamp 10 has a tubular envelope 12 made of a suitable light-transmitting material such as quartz or a borosilicate or aluminosilicate glass. A pair of lead-in wires 14 and 16 are press sealed in envelope 12 at press seal 18. Lead-in wires 14 and 16 are formed from a material, such as molybdenum, which will form a relatively strain-free hermetic seal with glass envelope 12. Further, as illustrated, lead-in wires 14 and 16 may include respective foil portions **14*a* and 16*a* within press 18 to facilitate such a seal. A tungsten filament structure 20, such as a coiled coil designed, for example, for 50-watt, 120-volt operation, is attached to the internal ends of lead-in wires 14 and 16. Envelope 12** is filled with a fill gas comprising an inert gas and a halogen or halide. Suitable examples of such an inert gas include argon and nitrogen. The halogen or halide additive, e.g., iodine or an iodide, which is in the gaseous state under the heat of lamp operation or may be incorporated as part of a gaseous compound, functions to reduce the coloration of the lamp envelope.

Lamps of the above variety are known today and examples of other halogen that have been used within the lamp envelope include bromine and chlorine, or respective halides thereof. Typically, the halogen or halide gases sealed in the lamp reduce envelope blackening and maintain the color temperature for the life of the lamp. In operation, tungsten particles from filament structure 20 evaporate and collide with the halogen gas particles, resulting in a chemical combination and formation of a halide. The halide in turn disassociates at high temperatures in the vicinity of the filament. Accordingly, tungsten particles are deposited on the filament and the halogen gas released to subsequently effect once again the described combination. The result of the above activity is a self-cleaning lamp which never darkens and yet produces maximum light output over its entire life. The described operation of tungsten-halogen lamps is well known in the art and further description, is, therefore, not believed necessary.

In an example of a preferred embodiment of the present invention, the manner of substantially eliminating the contaminants contained within a 50-watt lamp, and preventing filament sag, consisted of introducing an organic and an inorganic getter, in combination, into envelope 12. The combination found to be most suitable, and to give a surprising result, was that of a carbon-containing gaseous getter and a phosphorus-based gaseous getter, respectively. In particular, it was discovered that the interaction of carbon and phosphorus together provided superior gettering qualities than either of the two substances used alone. The carbon-containing gaseous getter was introduced into the lamp as methyl bromide ($CH_3Br$), in an amount of about 0.12%. Methyl bromide, halide, also served as the source of halogen needed for lamp 10. The phosphorus-based gaseous getter was introduced into lamp 10 in the form of phosphine gas ($PH_3$). The phosphine gas may be introduced in combination with the fill gas of the lamp so that upon normal phosphorus disassociation from the hydrogen (during lamp operation) an amount of phosphorus of about 1 to 10 micrograms will result.

The quantity of carbon and phosphorus required in a particular lamp may vary depending on the diameter of the filament wire and the volume of the lamp vessel used, but should be of such quantity that is sufficient to provide an effective gettering action within the particular lamp. The total dose would increase as a lamp's volume increased. As wattage increases, so must the carbon to phosphorus ratio. In the present invention, the carbon to phosphorus mass ratio is in the range of from about 4:1 to about 1:1. The quantity of carbon is about 4 to 10 micrograms; while the quantity of phosphorus is about 1 to 10 micrograms. The type of phosphorus preferred here is of the yellow phosphorus variety. In addition, the filament used here had a diameter in the range of about 0.005 inch to 0.020 inch. The aforementioned embodiment should serve only to clarify the manner in which the invention operates and not to limit its application to other lamps.

In gettering oxygen the carbon is most efficient at high temperatures (greater than 1000° Kelvin) and the phosphorus is more efficient at low temperatures (less than 1000° K.). This allows for more effective oxygen gettering over a large range of temperatures. Lamps made in the past not incorporating the aforementioned getters have exhibited early signs of failure or have been unable to reach lifetimes of four to five thousand hours. Lamps presently made with the carbon and phosphorus getters have not exhibited signs of early failure, have achieved lives of over four thousand hours and have produced lamps of superior quality.

Thus, there has been shown and described a tungsten halogen lamp having means incorporated therein for substantially eliminating the contaminants contained within the lamp and substantially reducing filament sag when the lamp is subjected to the process of flashing. More particularly, a combination of organic and inorganic getters is provided, in the form of a carbon-containing gaseous getter (e.g., methyl bromide ($CH_3Br$)) and a phosphorus-based gaseous getter (or phosphine ($PH_3$)), to effectively getter oxygen contained within the lamp.

While there have been shown what are at present to be the preferred embodiments of the invention, it will be apparent to those skilled in the art that various changes and modifications can be made therein without departing from the scope of the invention as defined in the appended claims.

What is claimed is:

1. A tungsten-halogen incandescent lamp comprising:
a light transmitting, hermetically sealed envelope;
a pair of lead-in wires press sealed in said envelope and extending internally and externally of said envelope;
a tungsten filament attached between the internal ends of said lead-in wires;
a fill gas within said envelope comprising an inert gas and a halogen or halide; and
means for gettering oxygen contained in said envelope, said gettering means comprising an organic getter in combination with an inorganic getter, said organic getter comprising methyl bromide and said inorganic getter comprising phosphine, wherein the carbon to phosphorus mass ratio is from about 4:1 to about 1:1.

2. The lamp according to claim 1 wherein the quantity of carbon is about 4 to 10 micrograms.

3. The lamp according to claim 2 wherein the quantity of phosphorus is about 1 to 10 micrograms.

4. The lamp according to claim 3 wherein said phosphorus is of the yellow-type phosphorus.

5. The lamp according to claim 1 wherein said filament has a diameter in the range of about 0.005 to about 0.20 inch.

6. The lamp according to claim 1 wherein said methyl bromide is in an amount of about 0.12% and said phosphine in an amount that results in about 1 to 10 micrograms of phosphorus after phosphorus disassociation from hydrogen occurs.

* * * * *